US008390184B2

(12) United States Patent
Pet et al.

(10) Patent No.: US 8,390,184 B2
(45) Date of Patent: Mar. 5, 2013

(54) LIGHTING SYSTEM, LIGHT SOURCE AND ELECTRODE DEVICE

(75) Inventors: Robert Pet, Eindhoven (NL); Clemens Johannes Maria Lasance, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 46 days.

(21) Appl. No.: 12/866,294

(22) PCT Filed: Feb. 9, 2009

(86) PCT No.: PCT/IB2009/050503

§ 371 (c)(1),
(2), (4) Date: Aug. 5, 2010

(87) PCT Pub. No.: WO2009/101561

PCT Pub. Date: Aug. 20, 2009

(65) Prior Publication Data

US 2010/0320896 A1 Dec. 23, 2010

(30) Foreign Application Priority Data

Feb. 14, 2008 (EP) ..... 08151421

(51) Int. Cl.
*H01J 5/54* (2006.01)

(52) U.S. Cl. ..... 313/317; 362/253; 362/800; 362/234

(58) Field of Classification Search ..... 362/226, 362/234, 239, 249, 250, 251, 253, 800, 806, 362/652, 640, 657; 313/317; 428/319.3, 428/304.4, 309.9, 344

See application file for complete search history.

(56) References Cited

U.S. PATENT DOCUMENTS

| | | | | |
|---|---|---|---|---|
| 5,010,463 | A * | 4/1991 | Ross | 362/253 |
| 6,132,859 | A * | 10/2000 | Jolly | 428/319.3 |
| 7,665,883 | B2 * | 2/2010 | Matheson | 362/652 |
| 2007/0091620 | A1 * | 4/2007 | Matheson | 362/367 |

FOREIGN PATENT DOCUMENTS

| | | | |
|---|---|---|---|
| BE | 571881 | A | 10/1958 |
| EP | 0109852 | A2 | 5/1984 |
| EP | 0116505 | A1 | 8/1984 |
| EP | 1167867 | A2 | 1/2002 |
| WO | 9808271 | A1 | 2/1998 |

* cited by examiner

*Primary Examiner* — Anh Mai
*Assistant Examiner* — Elmito Breval

(57) ABSTRACT

A system comprises a light source (42) and an electrode device (1). The light source comprises a base (46) with a base surface on which at least two contact elements (47, 48, 54) are provided. The electrode device has at least two electrodes (23, 24, 31, 32) in mutually stacked positions, which electrodes are preferably made of a permanent magnetic, ferromagnet or electro-magnetic material and have a different polarity during operation. The system further comprises at least one electrode comprising a layer of auto-closing material. This ensures that the system can maintain a satisfactory, reliable electric contact between the electrodes and the contact elements, and, after removal of the light source, gives the system a more aesthetic appearance because damages are practically invisible.

19 Claims, 2 Drawing Sheets

LIGHTING SYSTEM, LIGHT SOURCE AND ELECTRODE DEVICE

FIELD OF THE INVENTION

The invention relates to a system as defined in the pre-characterizing part of claim 1. The invention further relates to a light source and an electrode device both adapted for use in the system according to the invention.

BACKGROUND OF THE INVENTION

Such a system is marketed under the trade name of Dipline and described at the websites http://www.magiclite.com/dipline/diplilne.shtml and http://www.magiclite.com/downloads/PDFs/dipline.pdf. Dipline lit panel systems operate at low voltages, for example, 12 V or 24V. These known systems are promoted as self-powered, flat, flexible panels which serve as electrified walls or ceiling surfaces. It allows simple placement of light sources anywhere on a flat surface and has them light up instantly.

In the past few years, many relatively small light sources (=SLS), for example, LED products or miniature halogen lamps, have entered the market. Most of these products are retrofit so that they can be integrated in a current infrastructure with minimal investment. This, however, poses limitations on exploiting the full potential of SLS. Especially new buildings or homes provide the possibility of breaking away from the existing paradigms in lighting design. For example, it has already been proved that slim SLS lighting systems allow unobtrusive integration of lighting into a building. Apart from the different visual appearance of the lighting system, SLS-based systems also require new solutions for heat management, driver infrastructure, mechanical fixtures and user interfacing. One of the key value drivers of SLS integration in domestic environments is freedom of positioning. A consumer can create any desired lighting pattern by placing an SLS lighting system at any position on a wall or ceiling. Moreover, it is possible for a consumer to create his own atmosphere at home by combining several of these systems. In order that such a system works properly, it should allow easy positioning, fixation, and instant operation, and it should be robust.

The known electrode device is a panel, and its electrodes are plate-shaped electrodes which are arranged in a stacked position. The plate electrodes are separated by a plate-shaped electrically insulating layer and each plate electrode is preferably covered by a decorative (and electrically insulating) layer. The panels have typical dimensions of 1 square meter and a thickness of about 3 cm. The electrode device can be used to form façade walls or ceilings, or it can be alternatively applied as a cladding on existing walls, ceilings, or floors. The electrode device is connected to an electric energy supply system. The light sources, which are suitable for use in the known system, have pin-shaped electric contacts which are able to pierce the plate-shaped-electrodes and the intermediate electrically insulating layer. The pin-shaped electric contacts have different lengths so that, upon placing a light source on the electrode device, one electrode penetrates both plate electrodes and the other electrode penetrates only one plate electrode, thus realizing an appropriate electric contact with the electrode device. The pin-shaped electric contact penetrating both plate electrodes is partly coated with an electrically insulating layer so as to prevent short-circuiting of the two plate electrodes via this electric contact. The system allows positioning of lamps at any desired location, thus offering great creative freedom of designing lumination and/or illumination patterns, and easy exchange to suitable and/or desired light sources in dependence upon the required application.

However, various problems are encountered with the known system, in particular:

potential difficulties in managing heat generated by the at least one light source during operation because of the electrically (and thermally) electrically insulating layer between the electrodes;

due to switching the light source on and off, the electric contacts between the contact elements of the at least one light source and the electrodes will deteriorate and become unreliable as a result of the repeatedly thermal expansion and shrinkage of the contact elements of the at least one light source;

in current embodiments, users are limited to the use of pinboard-like walls if the visibility of the punched holes should diminish after removal of the at least one light source;

the known system is relatively inflexible and incapable of following relatively sharp contours of carrier materials (such as curved walls).

OBJECT AND SUMMARY OF THE INVENTION

It is an object of the invention to counteract at least one of the above-mentioned problems of the known prior-art system. To this end, the system as described in the opening paragraph is defined by the characterizing part of claim 1. When the light source is mounted on the electrode device, the electrode material will get damaged because it is pierced by relatively small piercing objects, for example, pin-shaped contact elements of the light source. An auto-closing material is understood to be a material that restores itself in such a way that its surface can be considered to be effectively closed, i.e. after the auto-closing material has restored itself, liquid or paste material cannot flow freely through the damaged spots, or the damaged spots have even disappeared. The material may restore itself when the piercing object is still present and/or after it has been removed. This gives the system according to the invention the advantage that it is capable of maintaining a satisfactory, reliable electric contact between the electrodes and the contact elements, and that it gives the system a more aesthetic appearance after removal of the light source because damages are practically invisible. Very suitable auto-closing materials are found among the group of materials consisting of rubber, low melting point metals/alloys, liquid metals/alloys, and metal/alloy pastes. The use of auto-closing rubber material as well as suitable rubber materials is known from medical applications, for example, a medicine bottle from which a small quantity of medicine is to be extracted via an injection needle piercing a rubber closure of such a bottle. Liquids and paste materials are capable of flowing freely and will thus auto-close, or in other words, fill up an open space which is left after a piercing element has been removed. A low melting point material is understood to be a material that is solid at room temperature, i.e. 20° C. to 25° C., but will become liquid due to the heat generated by the light source during operation and will thus maintain a reliable electric contact during operation. This material is capable of restoring itself to its original state when it is heated by the light source. Said melting points are preferably in the range of 30° C. to 200° C., or 30° C. to 120° C., or 50° C. to 80° C. Materials known to exhibit at least one of above-mentioned properties are Gallium, Indium, Ga68In20Sn12, Indalloy 117, SnPbInBi, Woods metal, Indalloy 1E, and silicon rubbers. The chemical composition, melting points and thermal conductivity of these metals/alloys are well known in the art.

In another embodiment, the system according to the invention is characterized in that the auto-closing material is chosen from the group consisting of metal/alloy paste, metal/alloys that are liquid at room temperature such as Galinstan, and is contained in between two auto-closing, solid layers. It is thus counteracted that the free-flowing materials can flow out of the system to the exterior, which improves the maintenance of the system.

In a preferred embodiment, the system is characterized in that the electrically conductive, auto-closing material has a volume resistivity of <=1 Ohm/cm. If the resistivity is relatively high, a relatively high power loss will occur in the electrodes, thus limiting the maximal power usable for operation of the light sources. It thus allows operation of the system with light sources having a relatively high nominal power. A very suitable embodiment for realizing the relatively low resistivity of <=1 Ohm/cm is characterized in that the conductive, auto-closing material is rubber and is provided as a coating on at least one electrode, but preferably on both electrodes. The electrode is embodied, for example, as a metal plate electrode or as a metal mesh cloth. If the auto-closing rubber faces the light source in its mounted position, it automatically gives the system a more aesthetic appearance after removal of the light source than is the case for a system with bare metal plate electrodes.

In another preferred embodiment, the system is characterized in that the electrodes comprise at least one ferrimagnetic, ferromagnetic or electromagnetic material. Easy mounting of the light source on the electrode device is attained when both electrodes are made of a magnetizable, permanent magnetic or electromagnetic material, and when the base of the light source is provided with a magnetizable, permanent magnetic or an electromagnetic adhesion device. The requirement imposed on the electric contacts of the lamp to be long and thick enough to mechanically fix the light source on the electrode device is thus no longer applicable; fixation of the light source on the electrode device is realized via magnetic adhesion instead.

To better deal with the heat generated by the light sources during their operation, an embodiment of the system is characterized in that the electrically conducting, auto-closing material and/or the electrically insulating layer has a thermal conductivity of at least 1 W/Mk which is suitable for layers having a thickness of 2.5 mm or less, but preferably more than 10 W/Mk which is suitable for layers having a thickness up to 20 mm. For this reason of heat management, the electrically insulating layer preferably has only a limited thickness of, for example, 5 mm. However, the electrically insulating layer should have a thickness of at least 1 mm to counteract short-circuiting between the two electrodes of the electrode device, and thus to ensure a reliable separation between these electrodes. In this respect, suitable materials are preferably chosen from the group consisting of thermally enhanced but electrically insulating materials such as are known in the field of thermal interface materials, for example, tabular alumina filled casting resin CC3-300 or thermally conductive, low-viscosity potting resin CC3-301AD-FR as available from Cast-Coat Inc.

In yet another embodiment, the system is characterized in that a protective and/or aesthetic screen is provided on the electrode closest to the light source in the mounted position and on a surface of said electrode facing the light source. The system can thus be embedded in environments which have a predetermined, aesthetic setting, for example, in old mansions, museums, or palaces.

The invention further relates to a light source having all light source characteristics of the system as defined in any one of the system claims 1 to 12 and to an electrode device having all electrode device characteristics of the system as defined in any one of the system claims 1 to 12.

BRIEF DESCRIPTION OF THE DRAWINGS

The invention will now be elucidated with reference to the diagrammatic drawings, in which.

DESCRIPTION OF EMBODIMENTS

Figure 1:
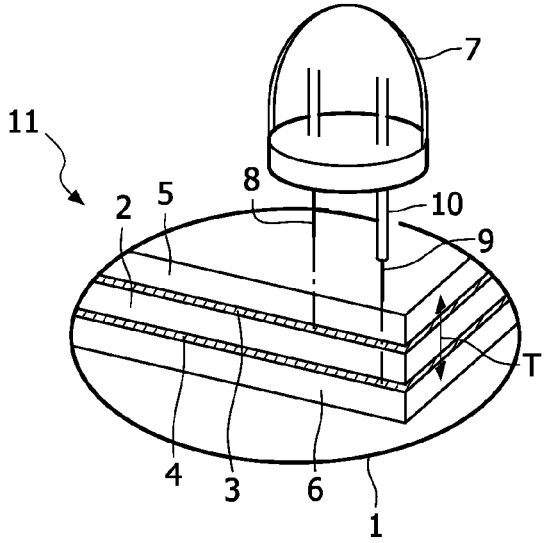
FIG. 1 PRIOR ART
FIG. 1 shows the system according to the prior art.

In the known prior-art system 11 shown in FIG. 1, the electrode device 1 is an electrically insulating plate 2 having both its main surfaces covered with thin metal foils which constitute a first electrode 3 and a second electrode 4. For mechanical and, optionally, aesthetic reasons, each electrode is covered with a respective screen 5, 6. The known electrode device typically has a thickness T of about 25 mm and the electrically insulating plate and screens are typically made of foam material. A light source 7 is mechanically mountable onto the electrode device 1 via a first electric contact 8 and a second electric contact 9. The first electric contact 8 is relatively short so that it cannot reach the second electrode 4 but can only pierce it and thus establish an electric connection with the first electrode 3. The second electric contact 9 is relatively long and can thus pierce both electrodes 3 and 4, thus establishing an electric connection with the second electrode. To avoid electric connection with the first electrode, the second electric contact is partly provided with an electrically insulating layer 10.

Figure 2:
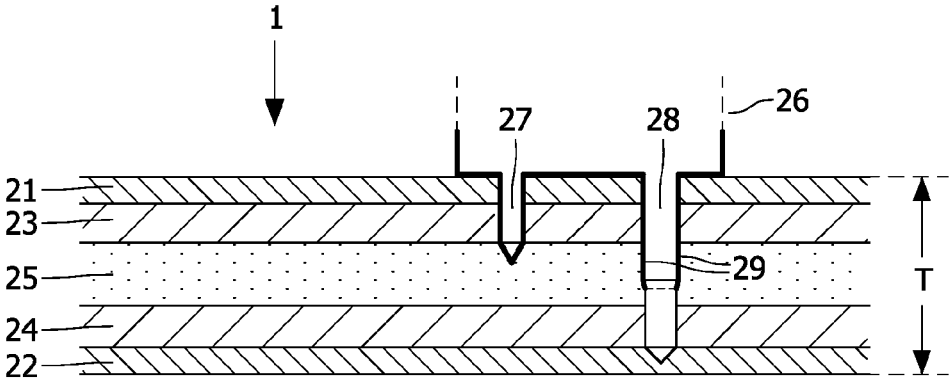
FIG. 2 is a cross-section through a first embodiment of an electrode device of a system according to the invention.

FIG. 2 is a cross-section of an electrode device 1 applicable in a system according to the invention. Similarly as in the prior-art system, the light source is to be mounted on the electrode device. The electrode device of FIG. 2 is built up of five layers: two outside layers 21, 22 each having a thickness of 1 mm and made of an electrically conducting, auto-closing rubber which are each adhered to a respective first electrode sheet 23 and a second electrode sheet 24 made of ferromagnetic (=permanent) stainless steel having a sheet thickness of 0.12 mm. The first and the second electrode sheet are separated by an electrically insulating layer 25 made of a suitable thermal interface material, for example, thermally conductive RTV silicon rubber CC3-1200 as available from Cast-Coat inc. and having a thickness of 2.6 mm. The electrode device thus has a total thickness T of less than 5 mm. The ferromagnetism of the electrode sheets allows the light source to be mounted onto the electrode device via magnetic adhesion, provided that the light source has a base with magnetizable elements (see FIG. 5). The light source 26 is roughly indicated in FIG. 2 with a first contact element 27 penetrating the first electrode sheet and a second contact element 28 penetrating both the first and the second electrode sheet, the second contact element being provided with an electrically insulating coating 29 so as to avoid short-circuiting of the two electrode sheets 23, 24. The light source may be a miniature halogen lamp, for example, one or more halogen lamps each having a nominal power of, for example, 20 W during operation, or it may be a LED or a plurality of LEDs each having a nominal power of, for example, about 3 W.

Figure 3:
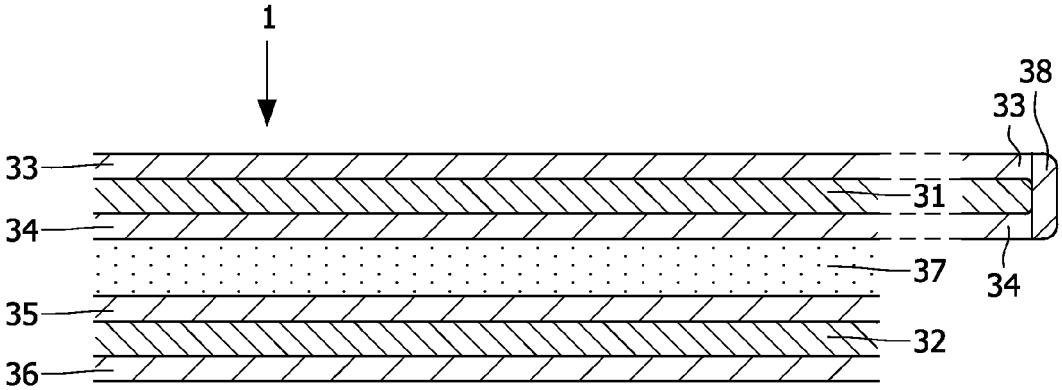
FIG. 3 is a cross-section through a second embodiment of an electrode device of a system according to the invention.

In FIG. 3, the electrode device 1 is a seven-layer structure. Two electrode layers 31, 32 are embodied as metal paste, for example, metal-filled pastes which are used to connect heat sinks to microprocessors, each electrode layer being contained in between two respective auto-closing silicon rubber layers 33,34,35,36, for which purpose two respective auto-closing rubber layers at each end of each electrode layer are mutually connected via a closing element 38. A central layer 37 is provided as an insulator between the electrodes and gives the electrode device its form stability. Likewise as in the prior-art system, the electrically insulating layer is relatively thick, for example, 1.5 cm, so as to allow mechanical fixation of the light source on the electrode device via pin-shaped contact elements of the light source.

Figure 4:
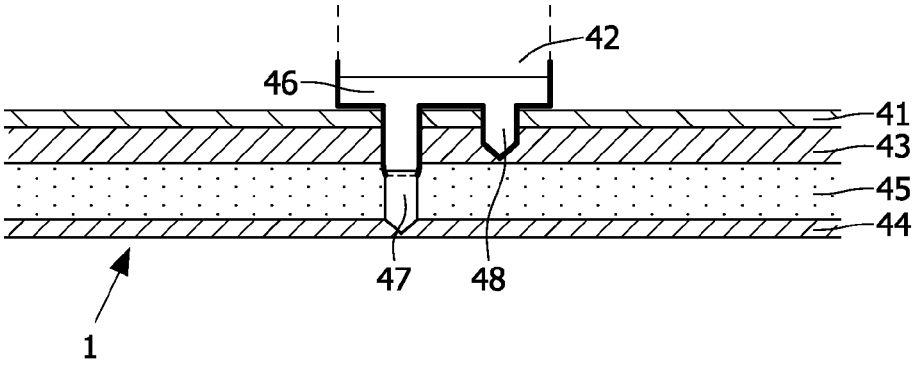
FIG. 4 is a cross-section through a third embodiment of an electrode device of a system according to the invention.

The electrode device 1 shown in FIG. 4 comprises four layers. An aesthetic screen top layer 41 faces the mounted light source 42. Two electrodes 43, 44 are made of a low melting point material, for example, Woods metal having a melting point of about 70° C., or InCuBi alloy having a melting point of 58° C., or Gallium metal having a melting point of 30° C. An electrically insulating but thermally conductive layer 45, made of a suitable thermal interface material is present between the two electrode layers 43,44. During operation, the mounted lamp generates heat which is transferred from the lamp base 46 to the electrode device. Due to this heat transfer, the low melting point material of the electrodes will melt locally adjacent the lamp base and/or contact elements and thus "wet" the pin-shaped electric contact elements 47, 48 of the light source. A satisfactory electric contact between the electrodes and the contact elements is thus ensured. Upon switching off the light source, the system cools down and the low melting point material solidifies again.

Figure 5:
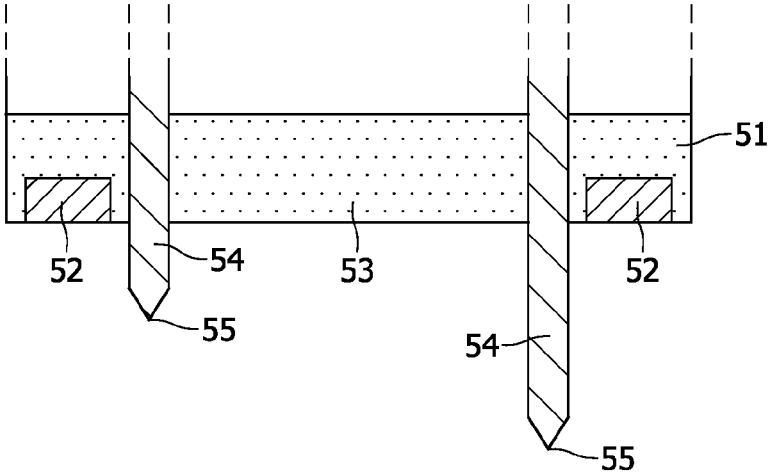
FIG. 5 is a cross-section through a lamp base of a light source of a system according to the invention.

FIG. 5 is a cross-sectional side view of the lamp base 51 of a light source. The base comprises at least two permanent magnetic or magnetizable elements, namely, two permanent magnets 52 in FIG. 5. The magnets are placed flush with the bottom 53 of the lamp base. Once mechanically connected, the lamp base will be stuck and held by magnetic force. Additional elements of the lamp base are at least two electric contacts 54 placed adjacent or at close distance to the magnets. Each electrode has a sharp, pin-shaped end 55 which extends from the bottom of the lamp base by a small distance and can pierce the various layers of the electrode device. The electric connection between the electrode device and the light source is established in this way.

The invention claimed is:

1. A system comprising an electrode device and a light source for emitting light, the light source comprising a base with a base surface on which at least two contact elements are provided, the electrode device having at least two electrodes in a stacked position and being separated by all electrically insulating layer, said two electrodes having a different polarity during operation, characterized in that at least one electrode comprises an electrically conductive, auto-closing material, wherein the electrically conductive, auto closing material is chosen from the group consisting of rubber, low melting point metals having a melting point in the range of 30° C. to 200° C., low melting point alloys having a melting point the range of 30° C. to 200° C., liquid metals, liquid alloys, metal pastes, and alloy pastes.

2. A system as claimed in claim 1, characterized in that the electrically conductive, auto-closing material has a volume resistivity of <=1 Ohm/cm.

3. A system as claimed in claim 1, characterized in that the conductive, auto-closing material is rubber and is provided as a coating on at least one electrode.

4. A system as claimed in claim 1, characterized in that the electrodes comprise at least one ferrimagnetic, ferromagnetic or electromagnetic material.

5. A system as claimed in claim 1, characterized in that the electrically conductive, auto-closing material has a thermal conductivity of at least 1 W/mK.

6. A system as claimed in claim 1, characterized in that the electrically conductive, auto-closing material is chosen from the group consisting of Gallium, Indium, Galinstan, Ga68In20Sn12, Indalloy 117, SnPbInBi, Woods metal, Indalloy 1E, and silicon rubbers.

7. A system as claimed in claim 1, characterized in that the electrically insulating layer has a thermal conductivity of at least 1 W/mK.

8. A system as claimed in claim 7, characterized in that the electrically insulating layer is chosen from the group consisting of thermal interface materials known as gap pads.

9. A system as claimed in claim 7, characterized in that the electrically insulating layer has a thickness in the range of 1 to 5 mm.

10. A system as claimed in claim 1, characterized in that a screen is provided on the electrode closest to the light source in a mounted position and on a surface of said electrode facing the light source.

11. A light source having all light source characteristics as defined in the system as claimed in claim 1.

12. A light source as claimed in claim 11, characterized in that it has a tamp base comprising fixation elements of ferrimagnetic, ferromagnetic or electromagnetic material.

13. An electrode device having all electrode device characteristics as defined in the system as claimed in claim 1.

14. A system as claimed in claim 1, characterized in that the electrically conductive, auto-closing material has a thermal conductivity of at least 10 W/mK.

15. A system as claimed in claim 1, characterized in that the electrically insulating layer has a thermal conductivity of at least 10 W/mK.

16. A system as claimed in claim 1, wherein:

one of the electrodes comprises a metal paste;

the metal paste is contained between two auto-closing rubber layers; and at an end of the electrode comprising the metal paste, the two auto-closing rubber layers are mutually connected via a closing element.

17. A method comprising:

providing an electrode device having first and second electrodes in a stacked position and being separated by an electrically insulating layer, said first and second electrodes having a different polarity during operation, wherein the first electrode comprises an electrically conductive, auto-closing material, wherein the auto-closing material is a low melting point material;

mounting on the electrode device a light source comprising a base with a base surface on which first and second contact elements are provided, wherein after mounting the first contact element contacts the first electrode and the second contact element contacts the second electrode; and operating the light source, wherein operating the light source comprises generating heat which is transferred from the base to the first and second contacts, wherein heat transfer from the first contact melts the low melting point material adjacent the first contact and the low melting point material wets the first contact.

18. The method of claim 17 wherein the low melting point material comprises one of Woods metal, InCuBi alloy, and gallium metal.

19. A system comprising an electrode device and a light source for emitting light, the light source comprising a base with a base surface on which at least two contact elements are provided, the electrode device having at two electrodes in a stacked position and being separated by an electrically insulating layer, said two electrodes having a different polarity during operation, characterized in that at least one electrode comprises an electrically conductive, auto-closing material and the auto-closing material is chosen from the group consisting of metal paste, alloy paste, metal liquid, and alloy liquid, and is contained in between two auto-closing, solid layers.

* * * * *